United States Patent [19]

Chen

[11] Patent Number: 4,614,031

[45] Date of Patent: Sep. 30, 1986

[54] NAIL CLIPPER

[76] Inventor: Steve Y. Chen, 3 W. 13th St., Hutchinson, Kans. 67501

[21] Appl. No.: 740,395

[22] Filed: Jun. 3, 1985

[51] Int. Cl.[4] ..... A45D 29/00

[52] U.S. Cl. ..... 30/28; 30/125; 132/75.5

[58] Field of Search ..... 30/28, 124, 125, 131; D28/60; 132/75.5

[56] References Cited

U.S. PATENT DOCUMENTS 1,182,247 5/1916 Buegeleisen ..... 30/28 X 1,436,610 11/1922 Carter et al. ..... 30/28 X

*Primary Examiner*—Douglas D. Watts

*Attorney, Agent, or Firm*—John H. Widdowson; John W. Carpenter

[57] ABSTRACT

A nail clipper comprising a stationary base having a structure defining a nail depository, a rear base end and a forward base end that terminates into a base jaw having a convexed base cutting edge. A pair of parallel tapering side walls is integrally bound to the stationary base. Each of the side walls include a back wall end and a front wall end having a top formed with a side wall recess seat. A resilient cover plate has a rear cover end bound to the rear base end and a forward cover end that terminates into a cover jaw. The cover jaw includes a convexed cover cutting edge that is capable of engaging the base cutting edge when the resilient cover plate is depressed. The nail clipper also includes a cover depressing lever with a level depressing end and a lever lug end that defines a pair of lugs which are pivotally received by the pair of side wall recess seats. A first end of a fulcrum-lever retention bar is rotatably connected to the cover plate and a second end of the fulcrum-lever retention bar defines a structure that is capable of acting as a fulcrum or as a retainer.

1 Claim, 8 Drawing Figures

FIG. 1
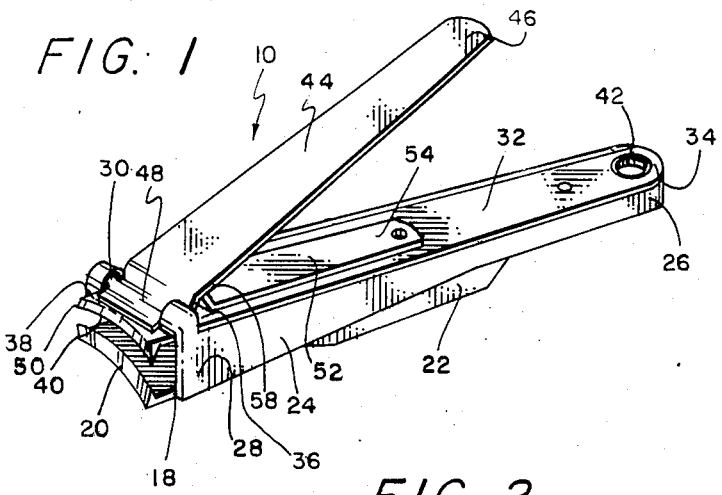
FIG. 2
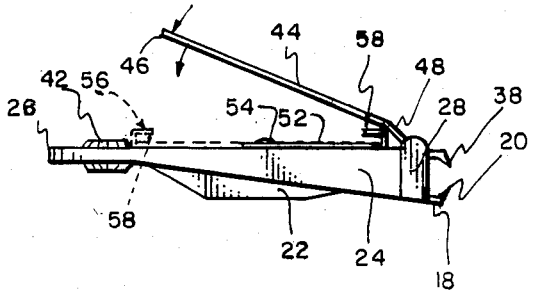
FIG. 4
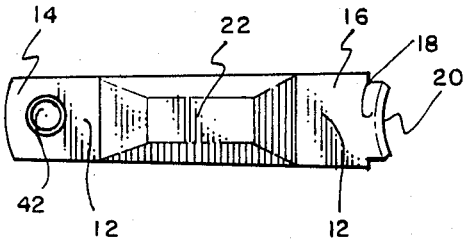
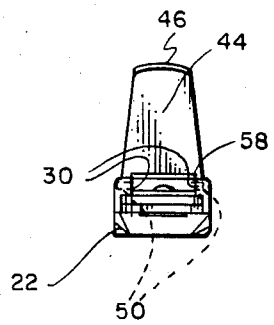
FIG. 3
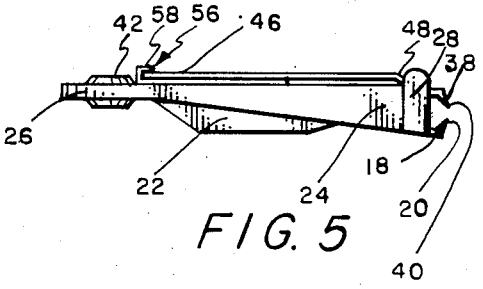
FIG. 5
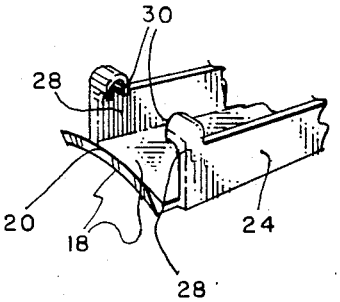
FIG. 8
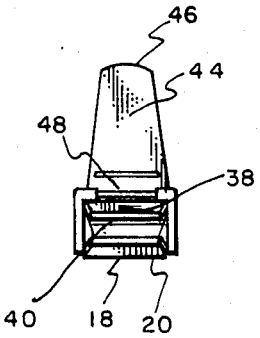
FIG. 6
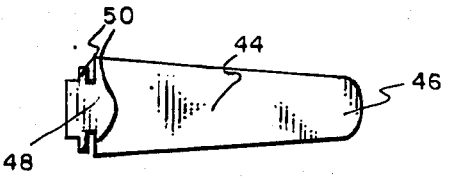
FIG. 7

NAIL CLIPPER

BACKGROUND OF THE INVENTION

1. Field of the Invention

This invention is related to a manicuring implement. More specifically, this invention provides a nail cutter which is believed to be a new style of a nail clipper.

2. Description of the Prior Art

U.S. Pat. No. 2,179,435 by Smith discloses a nail clipper that has a depository for convenient accumulation and trapping of the nail clippings. U.S. Pat. No. 3,180,025 to Tsunemi pertains to nail clippers that include a receptacle which is integral with the nail shearing elements of the nail clipper. U.S. Pat. No. 3,169,312 by Fink is concerned with new and useful improvements in nail clippers, and is more specifically directed toward a guard mountable on conventional nail clippers so as to assist in the collection of cut nails. None of the foregoing prior art patents teach or suggest the particular nail clipper of this invention.

SUMMARY OF THE INVENTION

The present invention accomplishes its desired objects by providing a nail clipper comprising a stationary base having a structure defining a nail depository, a rear base end and a forward base end that terminates into a base jaw having a convexed base cutting edge. A pair of parallel tapering side walls is integrally bound to the stationary base. Each side wall includes a back wall end and a front wall end having a top formed with a side wall recess seat. A resilient cover plate has a rear cover end which is bound to the rear base end. The cover plate also includes a forward cover end that terminates into a cover jaw having a convexed cover cutting edge which is capable of engaging the base cutting edge when the resilient cover plate is depressed. The nail clipper of this invention further includes a cover depressing lever with a lever depressing end and a lever lug end that defines a pair of lugs which are pivotally received by the pair of side wall recess seats. A first end of a fulcrum-lever retention bar is rotatably connected to the cover plate, and a econd end of the fulcrum-lever retention bar defines a fulcrum-retention means having a dual purpose. One purpose of the fulcrum-retention means is that when the fulcrum-lever retention bar is rotated forward, the fulcrum-retention means engages the under side of the cover depressing lever in proximity to the lever lug end to provide a fulcrum means for depressing or lowering the resilient cover plate when the lever depressing end is depressed. A second purpose of the fulcrum-retention means is to retain the lever depressing end of the cover depressing lever when the fulcrum-lever retention bar is rotated rearward.

Therefore it is an object of the present invention to provide an improved nail clipper.

It is another object of the present invention to provide a nail clipper which has a fulcrum-lever retention bar which may act as a fulcrum or as a retainer for the end of a cover depressing lever.

These together with the various ancillary objects and features will become apparent to those skilled in the art as the following description proceeds, are attained by this novel nail clipper, a preferred embodiment being shown with reference to the accompanying drawings, by way of example only, wherein:

BRIEF DESCRIPTION OF THE DRAWINGS

FIG. 1 is a perspective view of the nail clipper;

FIG. 2 is a side elevational view of the nail clipper;

FIG. 3 is a rear elevational view of the nail clipper;

FIG. 4 is a bottom plan-view of the nail clipper;

FIG. 5 is a side elevational view of the nail clipper disclosing the lever depressing end of the cover depressing lever engaged or retained by the fulcrum-retention means on an end of the fulcrum-lever retention bar;

FIG. 6 a front elevational view of the nail clipper;

FIG. 7 is a top plan view of the cover depressing lever; and

FIG. 8 is a partial perspective view of the front of the stationary base and the parallel tapering side wall disclosing the generally semi-conduit recess seats which rotatably receive the lugs of the cover depressing lever.

DETAILED DESCRIPTION OF THE INVENTION

Referring in detail now to the drawings, wherein similar parts of the invention are identified by like reference numerals, there is seen the nail clipper of this invention, generally illustrated as 10, comprising a stationary base 12 that has a rear base end 14, and a forward base end 16 which terminates into a base jaw 18 having a convexed base cutting edge 20. Stationary base 12 also includes a nail depository 22 for catching or receiving the severed nail portions, and for retaining the severed nail portions until such time as one desires to dispose of them.

The nail clipper 10 also includes a pair of parallel tapering side walls 24–24 that are integrally bound to the base 12. Each of the side walls 24–24 has a back wall end 26 and a front wall end 28 having a top formed with a generally semi-conduit recess seat 30 with a semi-circular front.

A resilient cover plate 32 has a rear cover end 34 bound to the rear base end 14 and a forward cover end 36 that terminates into a cover jaw 38 having a convexed cover cutting edge 40 that is capable of engaging the base cutting edge 20 when the resilient cover plate 32 is depressed.

The nail clipper 10 further includes a cover depressing lever 44 with a lever depressing end 46 and a lever lug end 48 that has a pair of lugs 50–50 which are pivotally, rotatably disposed or lodged in the pair of essentially semi-conduit recess seats 30–30. The lugs 50–50 are retained in the semi-conduit recess seats 30–30 from the upward biasing of the resiliant cover plate 32.

An end of a fulcrum-lever retention bar 52 is rotatably connectd to the cover plate 32 in close proximity to the middle thereof. Bar 52 additionally has another end defining a fulcrum-retention means generally illustrated as 56, which has a dual purpose. When the fulcrum retention bar 52 is pivoted or rotated forward (see FIGS. 1, 2 and 3), the fulcrum-retention means 56 engages the underside of the cover depressing lever 44 in proximity to the lever lug end 48 to provide a fulcrum for depressing or lowering the resilient cover plate 32 when the lever depressing end 46 is depressed (see FIG. 2). Another purpose of the fulcrum-retention means 56 is to retain the lever depressing end 46 of the cover depressing lever 44 when the fulcrum-lever retention bar 52 is rotated rearward (see FIG. 5 and the dotted line position of the bar 52 in FIG. 2). The fulcrum-retention means 56 may best be described as generally hookshaped with a top flange 58 that is generally parallel to the structure of the fulcrum-lever retention bar 52. The lever depressing end 46 of the cover depressing lever 44 is retained by the fulcrum-retention means 56 by sliding the lever depressing end 46 underneath the top flange 58 of the fulcrum-retention means 56.

The stationary base 12, the pair of parallel tapering side walls 24–24, the cover depressing lever 44, and the fulcrum-lever retention bar 52 are preferably manufactured of a strong, rigid metal or metal alloy, such as steel, or the like, which can retain sharpness at the cutting edges 20 and 40.

The cover plate 32 is preferably manufactured of a resilient material (e.g. spring steel, or the like) and may have its rear cover end 34 secured to the rear base end 14 by spot welding or a bolt 42 flanged at both ends. The cover plate 32 should have enough resilient strength to exert an upward bias that would retain the pair of lugs 50–50 of the cover depressing lever 44 within the generally semi-conduit recess seats 30–30 of side walls 24–24, in order to keep the cover depressing lever 44 in position for being depressed (see FIGS, 1 2, 3 and 6) to sever nails or in a stored position (see FIG. 5). The upward biasing of the cover plate 32 also prevents the cover depressing lever 44 from being separated from the remaining parts of the nail clipper 10. The cover jaw 38 diverges outwardly and away from the base jaw 18. Cutting edges 20 and 40 are convexed in order to achieve a neatly curved cutting of the fingernail, or toenail, that is cut when inserted between the two cutting edges 20 and 40 and the lever depressing end 46 of the cover depressing lever 44 is depressed. The cut nails immediately lodge in the nail depository 22 for retention until removed.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A nail clipper comprising a stationary base having a structure defining a nail depository, a rear base end and a forward base end that terminates into a base jaw having a convexed base cutting edge;

a pair of parallel tapering side walls integrally bound to said stationary base, each side wall includes a back wall end and a front wall end having a top formed with a side wall recess seat means;

a resilient cover plate having a rear cover end bound to the rear base end and a forward cover end that terminates into a cover jaw having a convexed cover cutting edge that is capable of engaging the base cutting edge when the resilient cover plate is depressed;

a cover depressing lever with a lever depressing end and a lever lug end that defines a pair of lugs which are pivotally received by the pair of side wall recess set means;

and a fulcrum-lever retention bar having a first end rotatably connected to said cover plate and a second end defining a fulcrum-retention means having a dual purpose, such that when the fulcrum-lever retention bar is rotated forward the fulcrum-retention means engages the underside of the cover depressing lever in proximity to the lever lug end to provide a fulcrum means for depressing or lowering the resilient cover plate when the lever depressing end is depressed, and to retain the lever depressing end of the cover depressing lever when the fulcrum-lever retention bar is rotated rearward; and each of said two side wall recess seats means has an essentially semi-conduit structure with a semi-circular front, wherethrough said pair of lugs rotatably lodge and are retained therein through the upward biasing of the resilient cover plate; and said first end of said fulcrum-lever retention bar is rotatably connected to said cover plate in close proximity to the center thereof; and said fulcrum-retention means of said second end of said fulcrum-lever retention bar includes a top flange that is generaly parallel to the structure of said fulcrum-lever retention bar, and said lever depressing end can be slidably disposed underneath said top flange.

* * * * *